US005383545A

United States Patent [19]

Schwarzli

[11] Patent Number: 5,383,545

[45] Date of Patent: Jan. 24, 1995

[54] COIN MECHANISM

[75] Inventor: Josef W. Schwarzli, Stouffville, Canada

[73] Assignee: Machine-O-Matic Limited, Newmarket, Canada

[21] Appl. No.: 22,102

[22] Filed: Feb. 25, 1993

Related U.S. Application Data

[63] Continuation-in-part of Ser. No. 836,212, Jan. 30, 1992, abandoned.

[51] Int. Cl.[6] ..... G07F 5/06

[52] U.S. Cl. ..... 194/202; 194/236

[58] Field of Search ..... 194/202, 203, 236, 237, 194/255, 292

[56] References Cited

U.S. PATENT DOCUMENTS 1,193,967 8/1916 Antoine et al. ..... 194/292

3,010,557 11/1961 Weitzman ..... 194/236

3,227,257 1/1966 Probasco ..... 194/255

3,937,314 2/1976 Rosenberg ..... 194/255

FOREIGN PATENT DOCUMENTS 1018661 10/1957 Germany ..... 194/236

*Primary Examiner*—F. J. Bartuska

*Attorney, Agent, or Firm*—Ridout & Maybee

[57] ABSTRACT

In a coin mechanism for a vending machine, the inner face of the coin mechanism body is provided with a raised edge over which the coin projects slightly. As the coin mechanism is rotated, the coin travels along this raised edge. A portion of the raised edge is ramped inwardly, so that the coin is separated from the coin receiving recess with an axial force, thereby overcoming any attempt to circumvent the coin mechanism by adhering the coin to the coin receiving recess using tape or glue.

2 Claims, 7 Drawing Sheets

FIG. 11
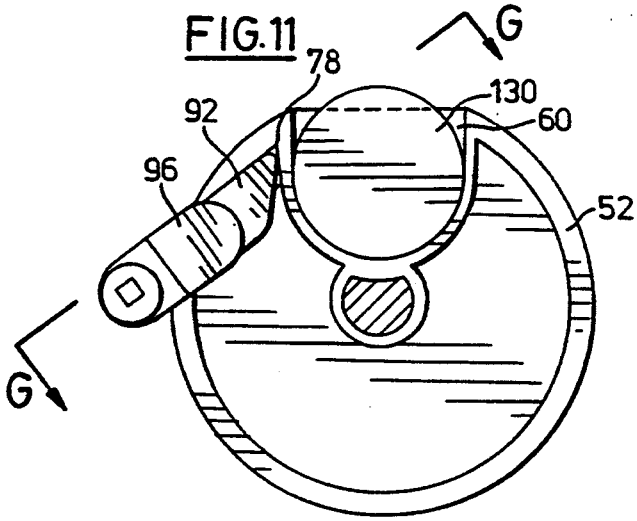
FIG. 12
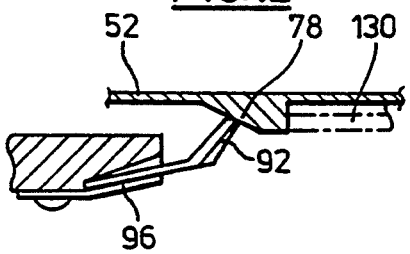
FIG. 13
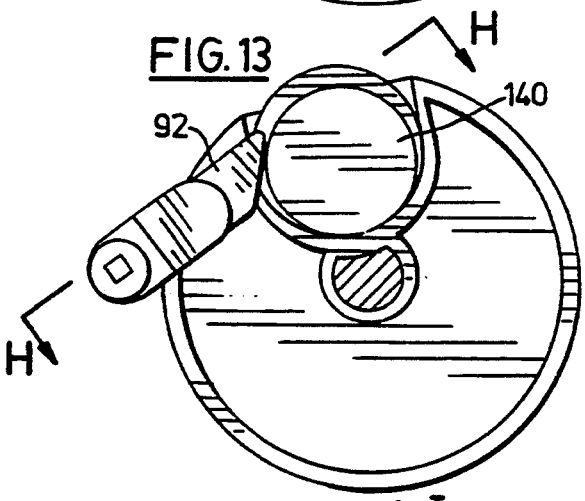
FIG. 14
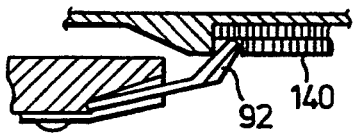
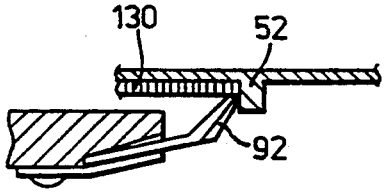
FIG. 16
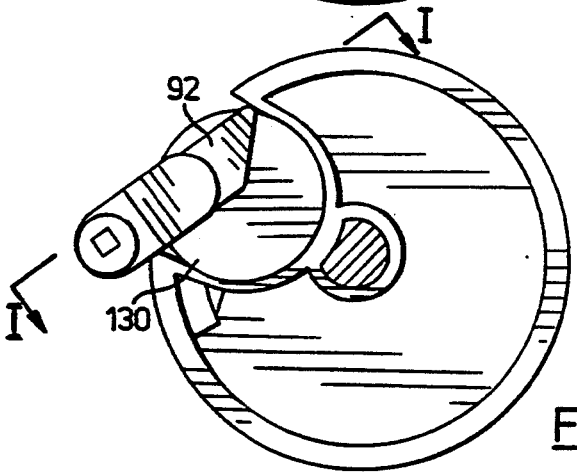
FIG. 15

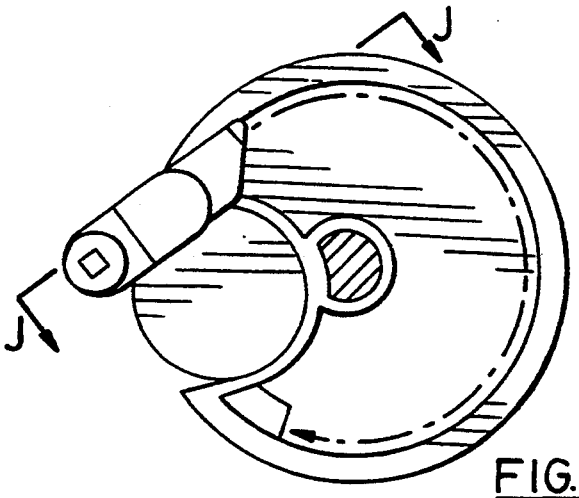
FIG. 17
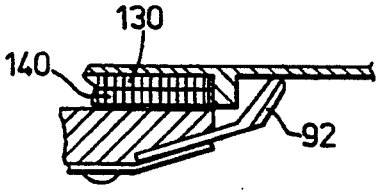
FIG. 18
FIG. 19
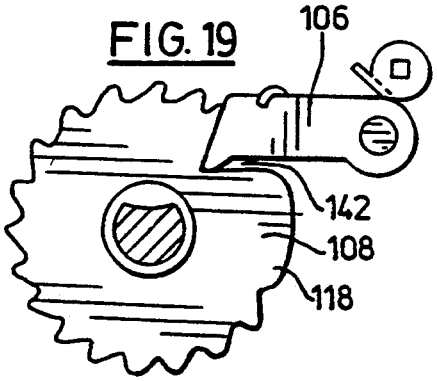
FIG. 20
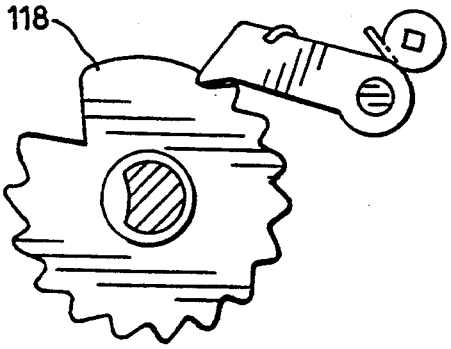
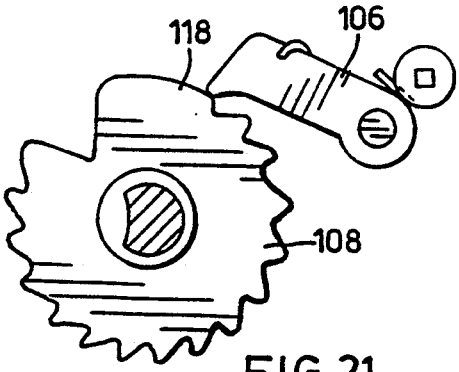
FIG. 21
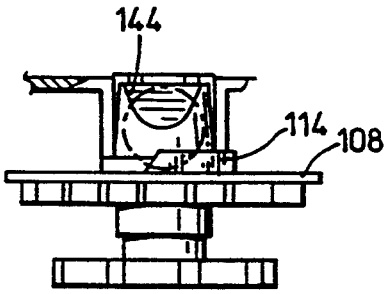
FIG. 22

COIN MECHANISM

This is a continuation-in-part of U.S. application Ser. No. 07/836,212 filed Jan. 30, 1992 now abandoned.

FIELD OF THE INVENTION

This invention relates to a coin mechanism for vending machines. In particular, the invention relates to a security mechanism for the coin mechanism.

BACKGROUND OF THE INVENTION

Conventional vending machines generally have a coin mechanism, into which a coin is placed, and a handle which is manually rotated to release an article from the machine, providing that a coin has been placed in the coin mechanism.

It is a common problem however, that coins of incorrect denomination and metal slugs are often fed into the coin mechanisms of vending machines in an attempt to defraud the vendor. Therefore, conventional vending machines include latch mechanisms which prevent rotation of the coin mechanism if a coin which is too thin, or if no coin at all, or if a grossly undersized coin, is used. These latch mechanisms normally comprise a blade which is biased perpendicularly into the recess of a coin receiving disc in which the coin is held. If a correctly sized coin is used, the blade merely runs over the face of the coin as the mechanism is rotated. However, if a grossly undersized coin or if no coin at all is located in the recess, the blade either snags between the coin and the walls of the recess or snags the walls of the recess, preventing rotation of the mechanism. However, this mechanism cannot detect if a slug or coin of a size similar to, but not equal to, a coin of the correct denomination is being used. Also, oversized coins or slugs are not readily detected.

In a further conventional mechanism, a lever is pivotally located to the side and above a rotatable coin receiving disc. One end of the lever is biased toward a recess in the disc in which the coin is received. If a correctly sized coin is used and the mechanism is rotated, the end of the lever runs on the rim of the coin and is lifted over the trailing edge of the recess. If the coin is too small, the end of the lever snags the trailing edge of the recess and prevents further rotation of the mechanism. This security mechanism is able to determine the diameter of the coin more accurately than the latching mechanism, but is susceptible to disengagement by means of wire, and the like, being pushed into the mechanism and used to raise the lever.

Unfortunately, both these conventional security mechanisms are not easily adapted to use with a coin mechanism which takes two coins in side-by-side relationship.

Another disadvantage of conventional coin mechanisms relates to the ability to circumvent the mechanism. One of the ways in which attempts are made to circumvent the coin mechanism in a bulk vendor is to apply a piece of two-sided tape or some glue to the face of a coin, and to then insert the coin into the coin receiving slot. The coin thereby adheres to the coin receiving recess, and as the coin mechanism is turned the coin either remains in the slot, permitting successive turns of the mechanism each of which allows merchandise to be dispensed, or jams the mechanism because a conventional sheer action coin discharging arm, which exerts only a radial force on the coin to extract it from the recess, is unable to overcome the force of the adhesive.

It is an object of this invention to provide a security mechanism for a coin mechanism which accurately determines the diameter of a coin placed in the mechanism.

It is further an object of this invention to provide a coin extraction device for a coin mechanism which prevents multiple dispensing and jamming when a coin is adhered to the coin receiving recess.

SUMMARY OF THE INVENTION

Accordingly, in one aspect, this invention provides a security mechanism for a coin mechanism of a vending machine, the coin mechanism including a rotatable coin receiving disc. The security mechanism comprises an escapement having an axis about which it pivots, a leading leg and a trailing leg, with one leg on each side of the axis, and the legs meeting at an angle about the axis. The trailing leg includes hooking means at its distal end. The security mechanism further comprises a lug, spaced a small distance from the axis, projecting from the escapement. The coin receiving disc has a cam and notch, which are spaced from each other a distance less than the distance between the distal end of the leading leg and hooking means of the trailing leg, and which are engageable by the distal end of the leading leg and the hooking means respectively. A coin, of a selected diameter, held in the coin receiving disc engages the lug of escapement on rotation of the disc, pivoting the escapement about its axis sufficiently for the leading leg of the escapement to clear the cam but insufficiently for the hooking means to engage the notch.

According to a further aspect, this invention provides a coin mechanism of a vending machine comprising a body portion having a slot for inserting coins; a rotatable coin receiving disc which is rotatable in the body portion; a handle with a shaft extending into the body portion to rotate the disc, a gear mechanism to activate the vending machine; and a security mechanism. The security mechanism comprises an escapement having an axis about which it pivots, a leading leg and a trailing leg, with one leg on each side of the axis, meeting at an angle about the axis, and a lug, spaced a small distance from the axis, projecting from the escapement. The trailing leg includes hooking means at its distal end. The coin receiving disc has a cam and notch, which are spaced from each other a distance less than the distance between distal end of the leading leg and hooking means of the trailing leg, and which are engageable by the distal end of the leading leg and the hooking means respectively. A coin, of a selected diameter, held in the coin receiving disc engages the lug of escapement on rotation of the disc, pivoting the escapement about its axis sufficiently for the leading leg of the escapement to clear the cam but insufficiently for the hooking means to engage the notch.

According to a still further aspect, this invention provides a coin mechanism for a vending machine comprising a body portion having a slot for inserting a coin, a coin receiving disc which is rotatable in the body portion having a coin receiving recess, a handle with a shaft extending into the body portion to rotate the disc, and a gear mechanism to activate the vending machine; wherein the coin receiving disc rotates in a cylindrical recess formed in the body portion, a portion of a coin projecting over a raised edge of the body portion along which the coin travels when the coin receiving disc is rotated, a portion of said raised edge being ramped to project progressively inwardly of the coin receiving disc and thereby to forcibly separate the coin from the coin receiving recess as the path of travel of the coin approaches the ramp.

BRIEF DESCRIPTION OF THE DRAWINGS

Embodiments of the invention are described, by way of example only, with reference to the drawings in which:

FIGS. 11, 13, 15 and 17 are sectional views, taken along F—F in FIG. 2, of a latch mechanism;

FIG. 12 is a part sectional view taken along G—G in FIG. 11;

FIG. 14 is a part sectional view taken along H—H in FIG. 13;

FIG. 16 is a part sectional view taken along I—I in FIG. 15;

FIG. 18 is a part sectional view taken along J—J in FIG. 17;

FIGS. 19, 20 and 21 are schematic views of a ratchet mechanism taken along K—K in FIG. 2;

FIG. 22 is a part top view of the coin mechanism;

DETAILED DESCRIPTION OF THE INVENTION

Figure 1:
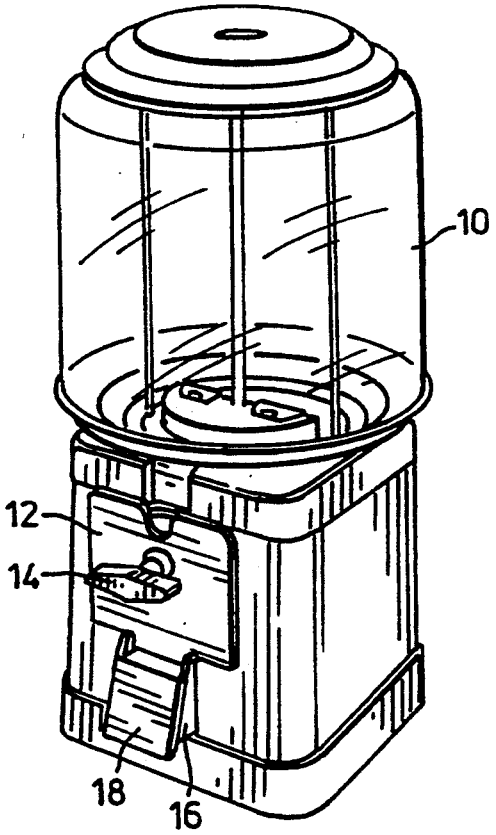
FIG. 1 is a perspective view of a vending machine which incorporates a coin mechanism.

FIG. 1 illustrates a vending machine 10 which includes a coin mechanism 12. As is conventional, articles such as chewing gum or toy capsules may be held within the vending machine. An article is released from the machine by placing a coin or coins in the coin mechanism 12 and turning its handle 14. The article then drops into the dispensing box 16 where it may be removed by lifting the flap 18.

Figures 2, 2A, 3, 4, 5:
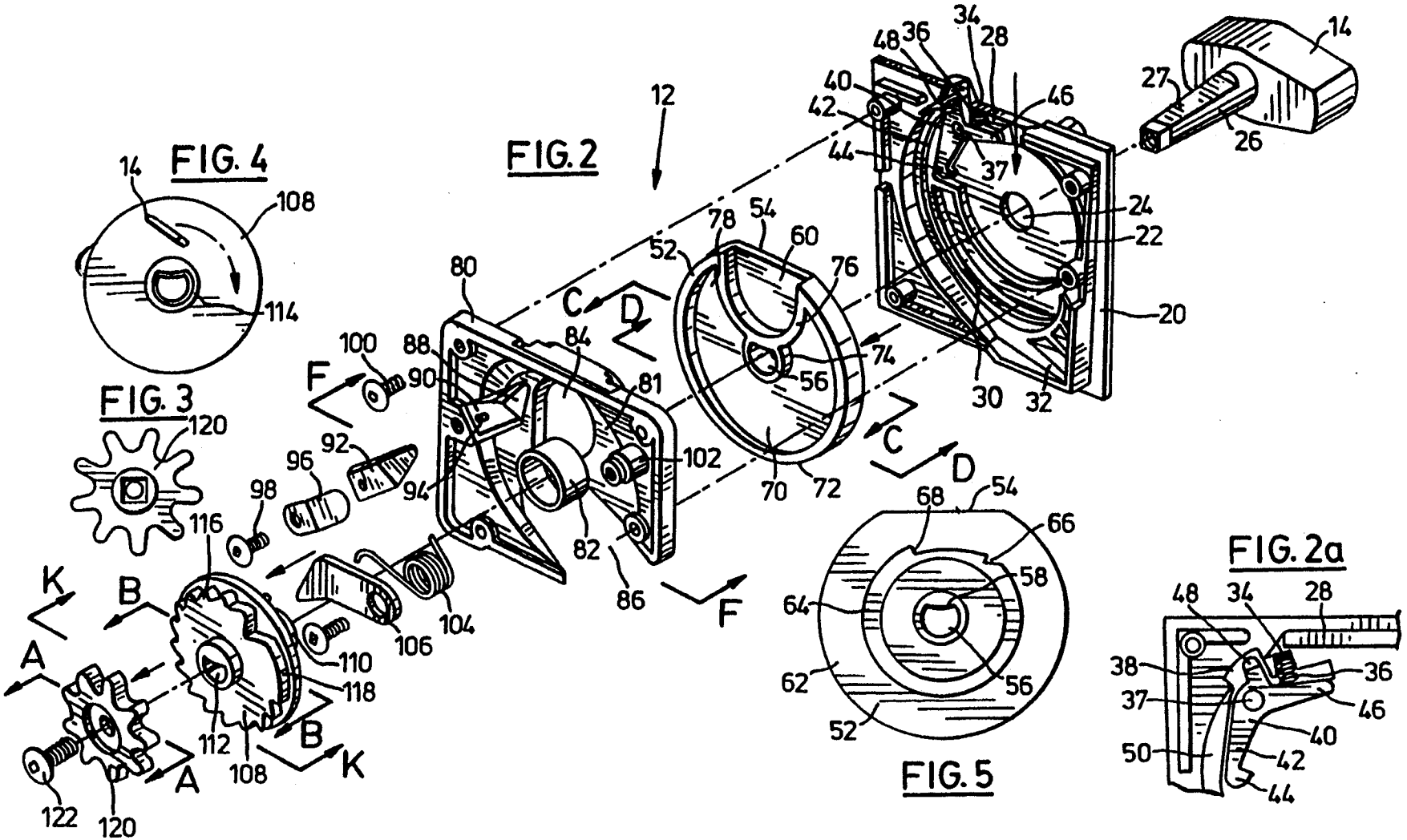
FIG. 2 is a perspective, disassembled, view of a coin mechanism.
FIG. 2*a* is an exploded elevation of an escapement in the coin mechanism.
FIG. 3 is an elevation taken along A—A in FIG. 2.
FIG. 4 is an elevation taken along B—B in FIG. 2.
FIG. 5 is an elevation taken along C—C in FIG. 2.
Figure 6:
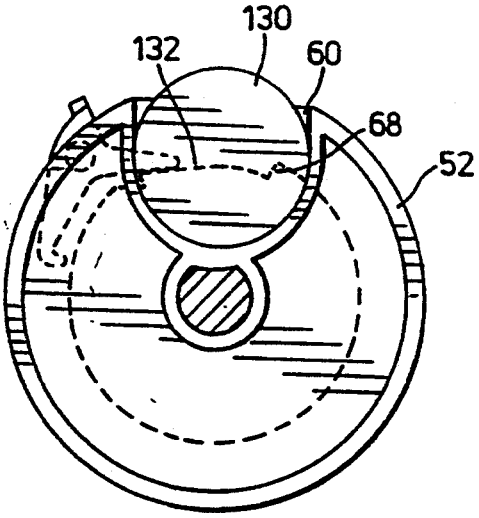
FIGS. 6, 7, 8 and 9 are schematic views of the coin mechanism taken along D—D in FIG. 2.

Turning to FIG. 2, the components of the coin mechanism 12 are shown in disassembled form. The coin mechanism 12 has an outer body 20 which has a substantially cylindrical recess 22 defined in it. The recess 22 is offset upwardly from the centre of the outer body 20 which results in flattening of the recess 22 at its upper edge. An axial bore 24 runs through the outer body 20 forming a passage through which the shaft 26 of the handle 14 extends, into the cylindrical recess 22. The shaft 26 has a flat edge portion 27. The outer body 20 has a slot 28 cut into its upper edge forming a passage to the cylindrical recess 22. In use, coins are pushed into the slot 28 to fall into the mechanisms contained in the cylindrical recess 22. The outer body thus far described is substantially conventional. In its operatively lower areas, the wall 30 of the cylindrical recess 22 projects inwardly of the coin mechanism 12 and is ramped to form an operatively lower chute 32 to provide an ejection mechanism for coins.

In particular, as can be seen in detail in FIGS. 23 to 26, a coin seated in the coin mechanism extends beyond the coin receiving recess 60 and projects slightly over the raised edge 50. At its upper limit, the raised edge 50 is approximately flush with the recess 60. As the mechanism is turned, the outer edge of the coin travels along the raised edge 50 until it approaches the extraction ramp 32, at approximately the point where the coin is situated in FIG. 25. The raised edge 50 is ramped progressively inwardly to separate the coin axially from the recess 60, so that by the time the coin approaches the extraction ramp 32 it is already partially separated from the recess 60. As the coin mechanism is further rotated, the coin slides along the extraction ramp 32 and is further separated axially from the coin receiving recess 60, until it drops into the cashbox.

It can thus be seen how attempts to circumvent the coin mechanism by adhering a face of the coin to the coin receiving recess 60 will not succeed in this preferred embodiment of the invention. The face of the coin can adhere to the face of the coin receiving recess 60 only until the coin reaches the raised edge 50, at which point the coin is gradually forcibly separated axially from the face of the coin receiving recess 60, and will neither remain seated for repeated turns of the coin mechanism nor jam the mechanism. A conventional mechanism, which is designed to separate the coin from the coin receiving recess 60 by forcing it radially or circumferentially, would in many cases be unsuccessful, because many types of tape and glue are sufficiently strong to withstand the sheer stress which a conventional mechanism would exert on the coin. By extracting the coin axially, as in the present invention, the outermost tip of the edge of the coin (at the bottom in FIG. 24) is pulled axially away from the coin receiving recess 60, thereby exerting a tensional stress on the adhesive, and ultimately prying the coin away from the coin receiving recess 60 as it moves toward the extraction ramp 32.

As best illustrated in FIG. 2*a*, the outer body further includes a small detent 34 formed into the inner face of the cylindrical recess 22 immediately below the corner of the slot 28 in the direction of a clockwise rotation of the handle 14. A small spring 36 is located in the detent 34. The inner face of the cylindrical recess further includes a small, cylindrical stud 37 which projects inwardly from the inner face into the recess 22. The stud 37 is positioned a small distance, in a clockwise turn of the handle 14, from the detent 34. A small recess 38 is formed in the operatively upper wall of the cylindrical recess 22 above the stud 37. An escapement 40, having a bore through it at its centre, pivots on the stud 37. The escapement 40 has two legs which meet about the bore at an obtuse angle. The operatively lower or trailing leg 42 of the escapement 40 has a radially inwardly extending hook 44 at its distal end. The other or leading leg 46 of the escapement compresses the spring 36 into the detent 34. The escapement 40 has an inwardly projecting lug 48 above the join of the two legs, which fits into the small recess 38 with the distal end of the lug 48 projecting from the recess. In operation, the spring 36 biases the leading leg 46 of the escapement 40 downwardly and the escapement 40 pivots about the stud 37 until the trailing leg 42 engages a raised side edge 50 in the inner face of the cylindrical recess 22.

A rotatable coin receiving disc 52, having a straight edge portion 54, fits snugly into the cylindrical recess 22. The disc 52 is of a thickness just slightly less than the width of the slot 28 so that, when it is rotated in the cylindrical recess 22, its rounded edge portions may extend into the slot 28 without impeding rotation. The disc 52 has an axial bore 56 through it, with a portion 58 of the bore 56 straightened to receive the shaft 26 of the handle 14 snugly. The disc 52 further has a coin receiving recess 60 formed in its face, opposite to the face 62 fitting into the cylindrical recess 22, radially inwardly of the straight edge portion 54. The coin receiving recess 60 is of a selected depth to receive a selected coin, or a selected number of such coins, in it without the coins projecting from its face or recessed from its face.

The cylindrical disc 52 thus far described is conventional.

However, as best illustrated in FIG. 5, the face 62 of the disc 52 has a raised annular portion 64 concentric with the axial bore 56. A notch 66 is cut into the annular portion 64 and is of a size sufficient to be securely engaged by the hook 44 of the escapement 40. A cam 68 is formed into the annular portion 64 at a distance from the notch 66 just sufficiently small that the ends of the escapement 40 cannot fit one into the notch 66 and one into the cam 68 at the same time. When positioned in the cylindrical recess 22, the disc 52 holds the escapement 40 on its stud 37 while the escapement 40 is free to pivot about the stud 37. The disc 52 further has a shallow recess 70 in it on the same side as the coin receiving recess 60. The shallow recess 70 extends over most of the face leaving only a peripheral wall 72, a wall 74 running about the axial bore 56, and a wall 76 separating it from the coin receiving recess 60. A small ramp 78 is provided adjacent the join of the peripheral wall 72 and separating wall 76 at the leading edge of the coin receiving recess 60.

An inner body 80 has an axial bearing 82, a shallow recess 81 formed into one of its faces, an upper aperture 84 through it above the bearing 82 and a cut-out 86 below the bearing 82 which, when the inner body 80 is joined to the outer body 20, is in register with the chute 32. A triangular aperture 88 extends through the inner body 80 at a position a small distance in the direction of a clockwise turn of the handle 14 starting from the upper aperture 84. A ramp 90 runs down to the triangular recess 88 from a position adjacent the side of the inner body 80. A latch blade 92 fits on a small stud 94 on the ramp 90 and extends through the triangular aperture 88 to project from the opposite face of the inner body 80. A resilient member 96 is held to the inner body 80 by a screw 98 and biases the latch blade 92 through the triangular aperture 88. In use, the latch blade 92 may be moved against the bias. The inner body 80 is held to the outer body 20 by suitable screws 100.

The inner body 80 further has a cylindrical projection 102 adjacent one corner. A tubular spring 104 fits about the cylindrical projection 102 and biases a pawl 106 away from the axis of the inner body 80.

A ratchet 108 has an axial projection 110 which fits into the bearing 82 of the inner body 80. An axial bore 112 extends through the axial projection 110 and the ratchet 108. The bore is shaped to snugly receive in it the shaft 26 of the handle 14. The face of the ratchet 108 having the axial projection 110 also includes a lug 114 running toward its outer edge, parallel to a tangent to the axial projection 110. This is best illustrated in FIG. 4. When the axial projection 110 has been slipped into the bearing 82, the pawl 106 engages the teeth 116 of the ratchet 108 to co-operate in a conventional manner to prevent the handle 14 from being turned in an anti-clockwise direction. The cam 118 on the ratchet 108 allows the mechanism to return to its starting position after a clockwise turn of the handle 14 which is sufficiently short not to fully activate the coin mechanism. Once the coin mechanism has been activated, the pawl 106 and ratchet 108 co-operate to prevent an anti-clockwise return of the mechanism to the start position.

As is conventional, a release gear 120 is attached to the distal end of the shaft 26 of the handle 14. A screw 122 secures the release gear to the shaft and, in turn, secures the components of the mechanism together. In use, the release gear 120 activates the mechanism which releases the article from the vending machine 10.

Figure 7:
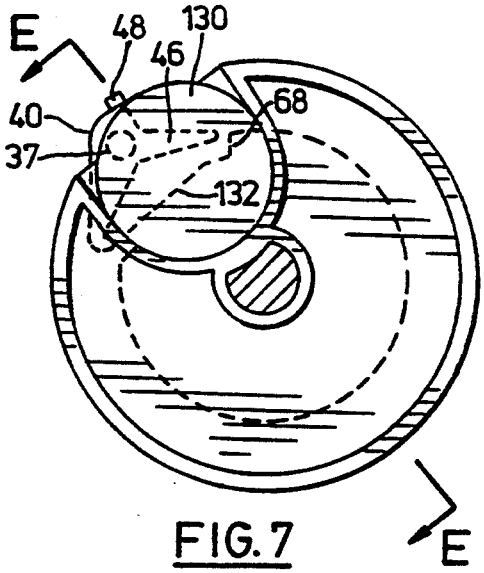
Figure 8:
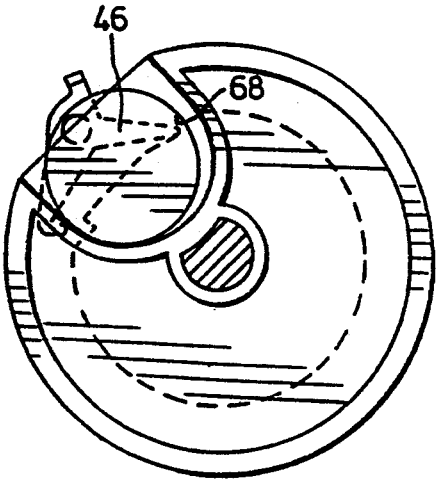

In operation, the assembled coin mechanism 12 is attached to a vending machine 10 as illustrated in FIG. 1. The coin mechanism 12 is operated by sliding a coin, or coins, into the slot 28. In a first embodiment, the mechanism is operated by use of a single coin. As best illustrated in FIGS. 6 to 9, the coin 130 falls through the slot 28 into the coin receiving recess 60 of the disc 52. Once in the recess 60, a portion of the coin 130 projects radially outwardly of the circumference of the disc 52. At this stage, the leading leg 46 of the escapement 40 rests on the leading edge 132 of the cam 68 on the raised annular portion 64 of the disc 52. The lug 48 of the escapement 40 extends over the periphery of the disc 52 but spaced a small distance above it. The handle 14 is then manually turned in a clockwise direction in order to activate the coin mechanism. As the handle 14 is turned, the disc 52 rotates in register with it. The distal end of the leading leg 46 rides over the leading edge 132 of the cam 68. If the coin 130 in the mechanism has a diameter sufficiently large, its peripheral rim engages the lug 48 of the escapement 40 as shown in FIG. 7. As the handle 14 is further turned, the lug 48 rides over the rim of the coin 130 which causes the escapement 40 to pivot about the stud 37. This pivoting action raises the leading leg 46 of the escapement 40, against the bias of the spring 36, from the leading edge 132 of the cam 68. Simultaneously, the trailing leg 42 of the escapement 40 is pivoted toward the raised annular portion 64 of the coin holder 52. If the diameter of the coin 130 is equal to or larger than the diameter of the coin designated for the mechanism, the leading leg 46 of the escapement 40 is pivoted upward sufficiently for its distal end to clear the cam 68 which would allow the mechanism to be further rotated. If the diameter of the coin 130 is smaller than the diameter of the coin designated for the mechanism, the leading leg 46 is not pivoted upwardly sufficiently and its distal end engages the cam 68 as shown in FIG. 8. This prevents further rotation of the mechanism.

Figure 9:
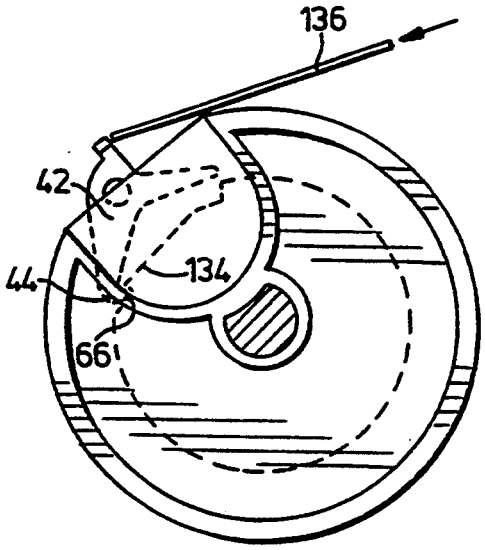

If the diameter of the coin 130 is larger than the diameter of the coin designated for the mechanism, the leading leg 46 of the escapement 40 is lifted over the cam 68. However it is lifted more than necessary which causes the trailing leg 42 to pivot into engagement with the raised annular portion 64 of the disc 52. Then, as the mechanism is further rotated, the hook 44, on the distal end of the trailing leg 42, rides on the trailing edge 134 of the cam 68. Once the mechanism is rotated sufficiently, the hook 44 engages into the notch 66 in the raised annular portion 64 preventing further rotation of the mechanism. This is best illustrated in FIG. 9 which illustrates the hook 44 engaging the notch 66 after an attempt has been made to lift the mechanism by means of a piece of wire 136. It would be clear to any person skilled in the art that the mechanism would operate in the same manner as if a coin with a diameter which is too large were in the coin receiving recess 60. This provides a much improved security feature as the mechanism detects both coins which are too small and coins which are too large. Also, if an attempt is made to lift the lug 48 by means of wire and the like, it must be lifted by only the correct amount as too much results in engagement of the hook 44 in the notch 66.

Figure 10:
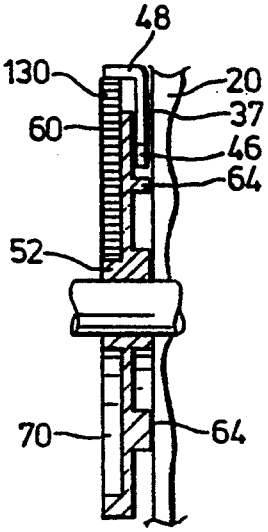
FIG. 10 is a sectional view taken along E—E in FIG. 7.
Figure 23:
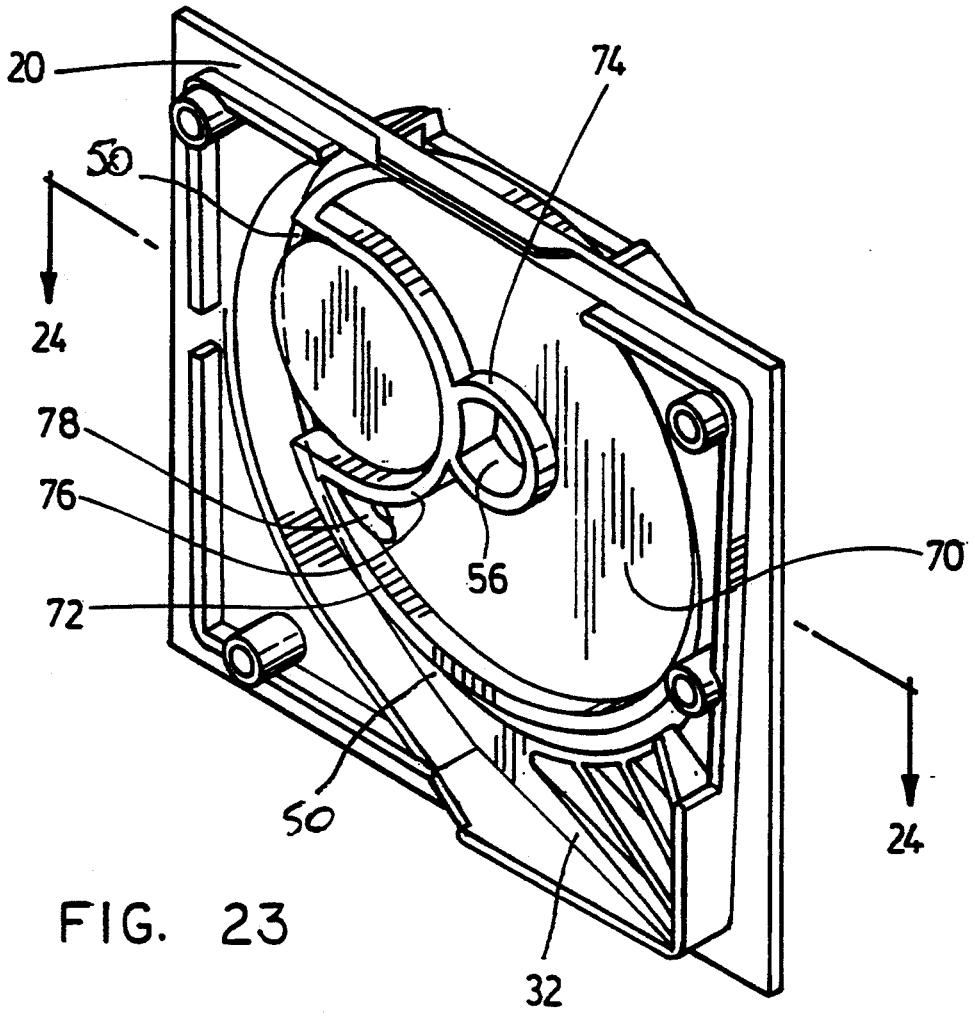
FIG. 23 is a perspective view of the coin mechanism illustrating details of the configuration of the extraction ramp.
Figure 24:
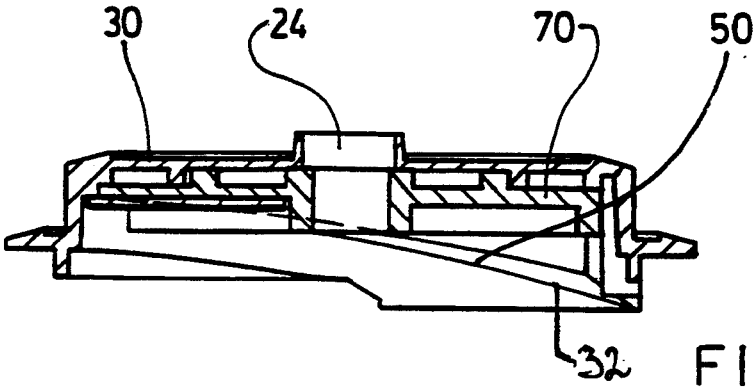
FIG. 24 is a cross-section of the coin mechanism taken along the line 24—24.
Figure 25:
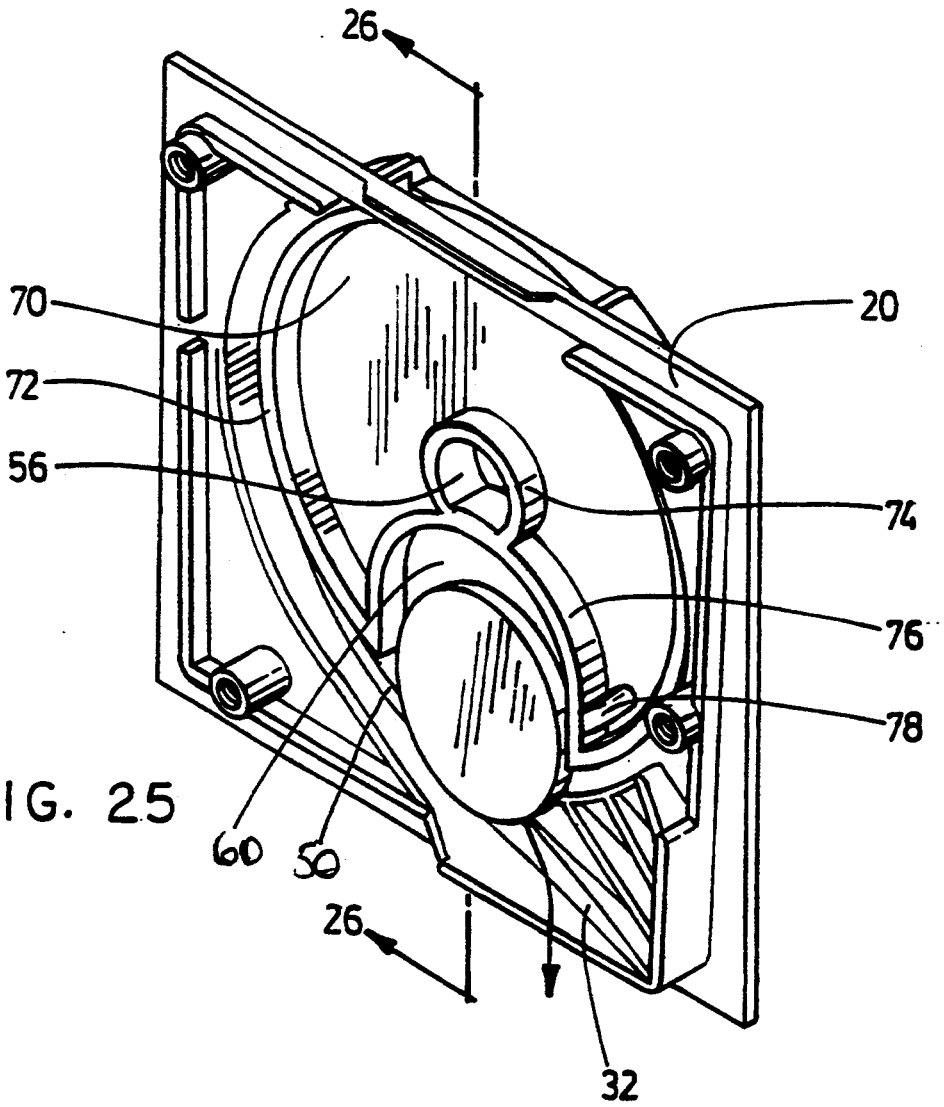
FIG. 25 is a perspective view showing the manner in which the extraction ramp separates a coin from the coin receiving recess.
Figure 26:
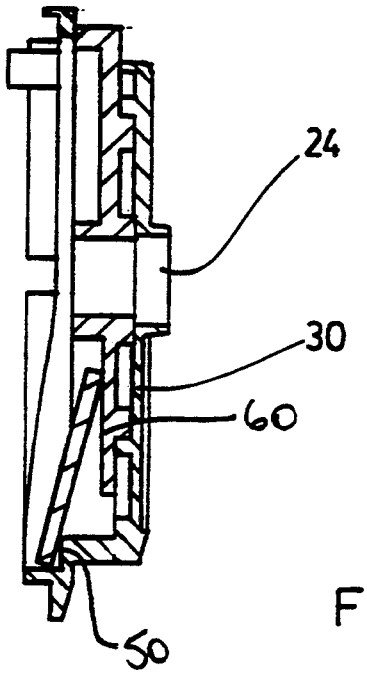
FIG. 26 is a cross-section of the coin mechanism taken along the line 26—26.

As shown in FIG. 10, the lug 48 extends over the rim of the coin 130 to a position just short of the opposite edge of the coin. In this manner, if two coins were required, the lug 48 would not engage the second coin. This ensures that the first coin must always be of the correct size.

As an additional security feature, the escapement 40 is located in a recess against the inner face of the cylindrical recess 22. The disc 52, which rotates in the cylindrical recess 22, covers the escapement 40 which greatly inhibits tampering with the escapement 40.

It is known that coins of a selected denomination do not have exactly the same diameter but are manufactured within certain tolerances. Therefore, the escapement 40, in combination with the cam 68 and notch 66 in the raised annular portion of the disc 52, have similar tolerances to allow the mechanism to be rotated if a coin of the correct diameter, or of a diameter within the tolerances specified in the specific country, is used. To further overcome problems relating to imprecise manufacture of coins, the distance between the centre of the stud 37 and the lug 48 is approximately ten times less than the distance between the centre of the stud 37 and the distal end on the leading leg 46. By this arrangement, a 0,01 mm increase in diameter of a coin causes the lug 48 to move outward 0,01 mm, but causes the distal end of the first leg 46 to move away from the coin by approximately 0,1 mm, a magnification of 10. Therefore, the diameters of coins may be extremely accurately measured by the escapement 40.

This mechanism operates adequately when the coin mechanism 12 receives only a single coin. However, if the mechanism receives two coins an additional mechanism is required as the escapement 40 only measures the diameter of the first coin.

In the embodiment where two coins are used, both coins are dropped through the slot 28 and fall into the coin receiving recess 60. The coins are held in the recess 60 in side-by-side relationship. As the handle 14 is turned in a clockwise direction, the escapement 40 determines the diameter of the coin closest to it in the manner described. Prior to turning of the handle 14, the latch blade 92, attached to the inner body 80, projects through the triangular aperture 88 and its distal end rests on the ramp 78 of the disc 52. This is best illustrated in FIGS. 11 and 12. As the handle 14 is rotated, the distal end of the blade rides up the ramp 78 and if a correctly sized second coin is in the recess 60, rides across the surface of the coin. The depth of the recess 60 is exactly the same as the thickness of both coins together so that when the trailing edge of the recess is brought into contact with the blade 92, the blade 92 rides smoothly over it and does not snag. This is shown in FIG. 18. If the second coin 140 is too small, the blade 92 slides between the leading edge of the recess and the coin 140 and prevents further rotation of the mechanism. This is shown in FIGS. 13 and 14. Alternatively, if only one coin has been placed in the recess 60, the thickness of the single coin 130 is insufficient to enable the blade 92 to ride over the trailing edge of the recess and the blade 92 engages this edge preventing further rotation of the mechanism. This is shown in FIGS. 15 and 16. Clearly, this latch blade mechanism may be used in the single coin embodiment as well. However, then the depth of the recess 60 is the same as the thickness of a single coin.

FIG. 19 illustrates the pawl 106 engaging in a notch 142 in the ratchet 108. As the handle 14 is turned, the ratchet 108 rotates and the pawl 106 rides over the cam 118 as shown in FIG. 21. Until the pawl 106 engages the first tooth 116 after the cam 118, the handle 14 may be rotated anti-clockwise and the mechanism returned to its rest position. The coins may be extracted at this stage. However, once the pawl 106 engages the first tooth 116, as shown in FIG. 20, the mechanism cannot be rotated in an anti-clockwise direction.

As described, the ratchet 108 has a lug 114 projecting toward the disc 52. In use, if a coin 144 which is much to small is placed in the coin receiving recess 60, it often would fall over and could possibly block the mechanism. However, if this occurred, the small coin 144 would be engaged by the lug 114 and, as the ratchet 108 rotates, ejected from the mechanism through chute 32. This is illustrated in FIG. 22.

The invention provides the additional advantage that the coin mechanism 12 may be changed from a single coin mechanism to a double coin mechanism by merely changing the disc 52 and the escapement 40. The escapement 40 is changed to an escapement 40 with a shorter lug 48 which would only engage the first coin. No other component need be changed.

Also, the axial bearing 82 on the inner body 80 provides an additional bearing for the shaft 26 of the handle 14. The prior art mechanisms are supported only by a single bearing which often wears. This allows the shaft in the prior art mechanisms to deviate from its proper axis of rotation which may cause the release gear to disengage from the release mechanism of the vending machine.

I claim:

1. A coin mechanism for a vending machine comprising a body portion having a slot for inserting a coin, a coin receiving disc which is rotatable in the body portion having a coin receiving recess aligned with the coin slot at a beginning of a path of travel of the coin in the coin receiving recess, the path of travel of the coin ending at an extraction ramp, a handle with a shaft extending into the body portion to rotate the disc, and a gear mechanism to actuate a dispensing wheel in the vending machine;

wherein the coin receiving disc rotates in a cylindrical recess formed in the body portion, a portion of a coin projecting over a raised edge of the body portion along the path of travel of the coin, a portion of said raised edge being ramped along a substantial portion of the path of travel of the coin to project progressively inwardly of the coin receiving disc and thereby to forcibly separate the coin axially from the coin receiving recess as the coin travels along the raised edge, wherein the raised edge has an upper limit adjacent to the slot.

2. A coin mechanism for a vending machine comprising a body portion having a slot for inserting a coin, a coin receiving disc which is rotatable in the body portion having a coin receiving recess aligned with the coin slot at a beginning of a path of travel of the coin in the coin receiving recess, the path of travel of the coin ending at an extraction ramp, a handle with a shaft extending into the body portion to rotate the disc, and a gear mechanism to actuate a dispensing wheel in the vending machine;

wherein the coin receiving disc rotates in a cylindrical recess formed in the body portion, a portion of a coin projecting over a raised edge of the body portion along the path of travel of the coin, a portion of said raised edge being ramped along a substantial portion of the path of travel of the coin to project progressively inwardly of the coin receiving disc and thereby to forcibly separate the coin axially from the coin receiving recess as the coin travels along the raised edge, wherein the portion of the raised edge which is ramped extends from approximately half-way along the path of travel of the coin to the extraction ramp.

* * * * *